United States Patent [19]

Bastian et al.

[11] 4,192,442

[45] Mar. 11, 1980

[54] ROLL SHEET DISPENSER

[75] Inventors: Lehyman J. Bastian, Media, Pa.; Richard D. Kley, New Castle, Del.

[73] Assignee: Scott Paper Company, Philadelphia, Pa.

[21] Appl. No.: 950,830

[22] Filed: Oct. 12, 1978

[51] Int. Cl.[2] ..... B65H 17/26

[52] U.S. Cl. ..... 226/127; 226/133; 242/55.53

[58] Field of Search ..... 226/127–133; 242/55.53; 74/25, 32, 44, 141.5, 142

[56] References Cited

U.S. PATENT DOCUMENTS

| | | | |
|---|---|---|---|
| 1,229,533 | 6/1917 | Shattuck | 312/39 |
| 2,248,193 | 7/1941 | Price et al. | 226/131 |
| 2,465,033 | 3/1949 | Ocheltree | 74/25 |
| 2,957,636 | 10/1960 | Lesavoy | 242/55.53 |
| 2,973,958 | 3/1961 | Casey et al. | 226/130 |
| 3,107,957 | 10/1963 | Batlas et al. | 312/39 |
| 3,138,312 | 6/1964 | Newman | 226/128 |
| 3,459,353 | 8/1969 | Taylor | 226/132 |
| 3,606,125 | 9/1971 | Tucker et al. | 226/130 |
| 4,141,516 | 2/1979 | Olson | 242/55.53 |

*Primary Examiner*—Leonard D. Christian
*Attorney, Agent, or Firm*—Joseph H. Yamaoka; William J. Foley

[57] ABSTRACT

A sheet material dispensing apparatus wherein the sheet passes through a nip formed by a drive roller and a pressure roller. A lever is mounted for rotation about a first point and a gear segment is mounted for rotation about a second point. When the lever is rotated, a point or surface on the lever slidingly contacts a point or surface on the gear segment causing the gear segment to rotate through a greater angle than the lever. The teeth of the gear segment are operably engaged with gear means which causes rotation of the drive roller. In another aspect of the invention, the gear means for rotating the drive roller includes a floating gear mounted in a slot that is aligned generally parallel to the teeth of the gear segment and which causes rotation of the drive roller during one direction of travel of the gear segment and is disengaged from the drive roller during the other direction of travel of the lever. The invention also employs an overload mechanism which prevents excessive force from being applied to the gears in the event the dispenser becomes jammed.

8 Claims, 5 Drawing Figures

ROLL SHEET DISPENSER

TECHNICAL FIELD

This invention relates to a dispenser for sheet material, in which the sheet material passes through a nip formed by a drive roller and a pressure roller, and in which rotation of the drive roller causes the sheet to be dispensed from the cabinet. In particular this invention is directed to the apparatus that causes rotation of the drive roller. The invention is particularly useful for dispensing paper towels from a cabinet.

BACKGROUND ART

One prior art, lever operated, sheet dispenser wherein the sheet material is dispensed through a nip formed by a drive roller and a pressure roller is described in U.S. Pat. No. 3,459,353-Taylor. In Taylor, a manually operated lever and a toothed quadrant member have a common center of rotation. The drive roller has a shaft to which is attached a gear that is driven by the quadrant member. Interposed between the gear and the drive roller is a one-way clutch mechanism which allows the rotational motion of the gear to be transmitted to the drive roller for only one direction of rotation of the gear. Since the sheet is dispensed when the lever travels in one direction and is not dispensed when the lever travels in the other direction, it is generally necessary to use a drive roller that has a relatively large diameter in order to dispense a desired length of the material for a single operation of the lever. Since the force applied to the lever must overcome the force applied to the drive roller by the pressure roller, it would be desirable to employ a drive roller with a relatively smaller diameter and to increase the angular rotation of the drive roller during a single operation of the lever in order to dispense the desired length of the sheet material.

One prior art approach for increasing the angular rotation of a drive roller in a lever operated dispenser is described in U.S. Pat. No. 3,606,125-Tucker et al. Tucker et al discloses a towel dispenser in which a manually-operated lever and a pair of toothed quadrant members all have the same center of rotation. The drive roller shaft has attached thereto first and second gears, one of the gears being driven by one quadrant member when the lever travels in one direction and the other gear being driven by the other quadrant member when the lever travels in the other direction so as to dispense toweling during both the advance and return strokes of the lever.

Other lever-operated towel dispensers that employ a gear driven drive roller are described in U.S. Pat. Nos. 1,229,533-Shattuck and 3,107,957-Batlas et al. In those patents the gear means are driven by a pawl and ratchet assembly which limits the drive roller to a single direction of rotation.

There is another advantage to having the lever rotate through a relatively small angle in order to dispense a desired length of toweling. If the lever must rotate through a very large angle, then the lever must either be mounted on the side of the cabinet, or if mounted on the front of the cabinet may prove to be too cumbersome during operation or servicing of the cabinet. If the lever rotates through a small angle, it can be mounted so that only the end of the lever projects through the front wall of the dispenser.

Lever-operated dispensers generally employ some type of spring means for returning the lever to a starting position. As the lever is moved away from the starting position, the force of the return spring acting on the lever increases with the distance of the lever from the starting position. It would, therefore, be desirable to have the mechanical advantage of the feed roller drive mechanism increase as the lever moves away from the starting position which would, at least in part, compensate for the increased force on the lever resulting from the return spring.

DISCLOSURE OF THE INVENTION

This invention is related to a sheet material dispensing apparatus wherein the sheet passes through a nip formed by a drive roller and a pressure roller. A lever is mounted for rotation about a first point and a gear segment is mounted for rotation about a second point. When the lever is rotated, a point or surface on the lever slidingly contacts a point or surface on the gear segment, and since the distance from the center of rotation of the lever to the contact point is greater than the distance from the center of rotation of the gear segment to the contact point, when the lever travels through a given angle of rotation, the gear segment travels through an angle of rotation that is greater than said given angle. The teeth of the gear segment are operably engaged with gear means which causes rotation of the drive roller.

In another aspect of the invention, the gear means driven by the gear segment includes a floating idler gear mounted in a slot that is aligned generally parallel to the teeth of the gear segment. The mounting slot for the gear is located so that the floating idler gear is engaged by the gear segment. When the lever is advanced in one direction, rotation of the gear segment moves the floating gear along the slot into driving engagement with a gear attached to the shaft of the drive roller which causes rotation of the drive roller and dispensing of the sheet material. When the lever travels back toward the return position, the gear segment reverses its direction of rotation and the floating gear moves in the opposite direction in the slot and is disengaged from the gear mounted on the drive roller thereby removing drive from the drive roller.

The invention also employs an overload mechanism which prevents excessive force from being applied to the gears in the event the dispenser becomes jammed. The assembly that causes rotation of the gear segment includes a lever and an actuator, both mounted for rotation about the same point, and further includes a stop which limits the relative rotation of the lever with respect to the actuator. A spring biases the actuator and the lever at the stop so that under normal conditions the actuator and lever rotate in unison. The actuator provides the contact point whereby the motion of the lever causes rotation of the gear segment. If the dispenser should become jammed or the gear segment should otherwise be prevented from rotating, an excessive force applied to the lever that exceeds the force of the spring biasing the lever and actuator at the stop, will cause the spring to expand thereby allowing the lever to move with respect to the actuator. Thus, the spring absorbs some of the energy when the roller drive means is subjected to high shock forces.

It is an object of this invention to provide an improved sheet material dispenser.

It is another object of this invention to provide an improved sheet material dispenser wherein the sheet material is fed through a nip formed by a drive roller and a pressure roller.

And yet another object of this invention is to provide a lever-operated sheet material dispenser wherein the lever mechanical advantage increases as the lever moves away from the starting position.

Another object of this invention is to provide a lever-operated sheet material dispenser in which the sheet material passes through a nip formed by a drive roller and a pressure roller and which uses a simple mechanism for removing the drive from the drive roller when the lever is moving in the return direction.

BRIEF DESCRIPTION OF THE DRAWINGS

While the specification concludes with claims particularly pointing out and distinctly claiming that which is regarded as the present invention, the objects and advantages of this invention can be more readily ascertained from the following description of a preferred embodiment when read in conjunction with the accompanying drawings in which:

BEST MODE FOR CARRYING OUT THE INVENTION

Figure 1:
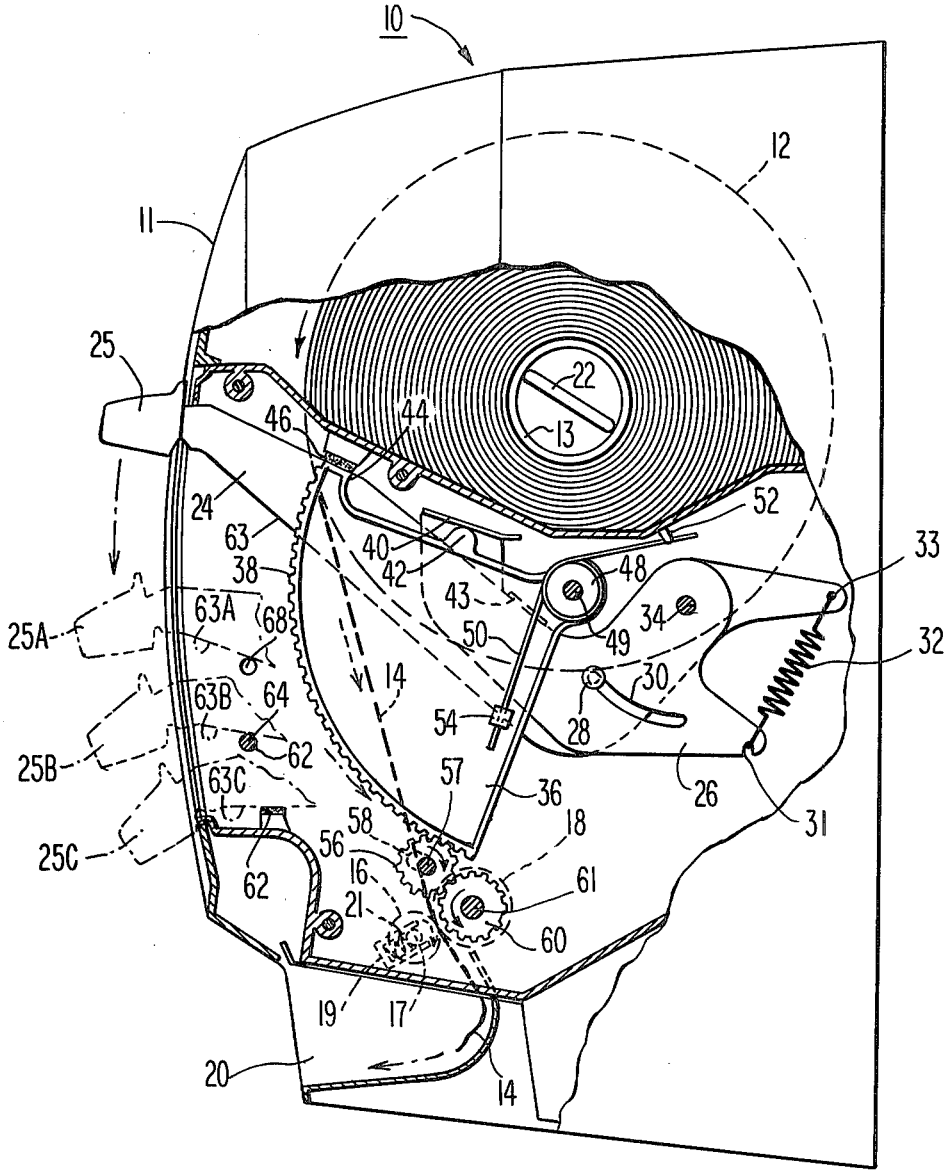
FIG. 1 is a side elevation view of the dispensing cabinet with portions of the cabinet walls being cut away to illustrate the lever operated dispensing apparatus of this invention.
Figure 3:
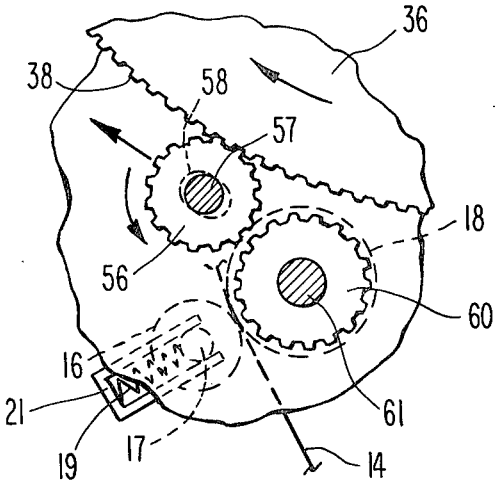
FIG. 3 is a partial side elevation of the gearing for the drive roller illustrating how the gearing is disengaged from the drive roller during the return stroke of the lever.
Figure 4:
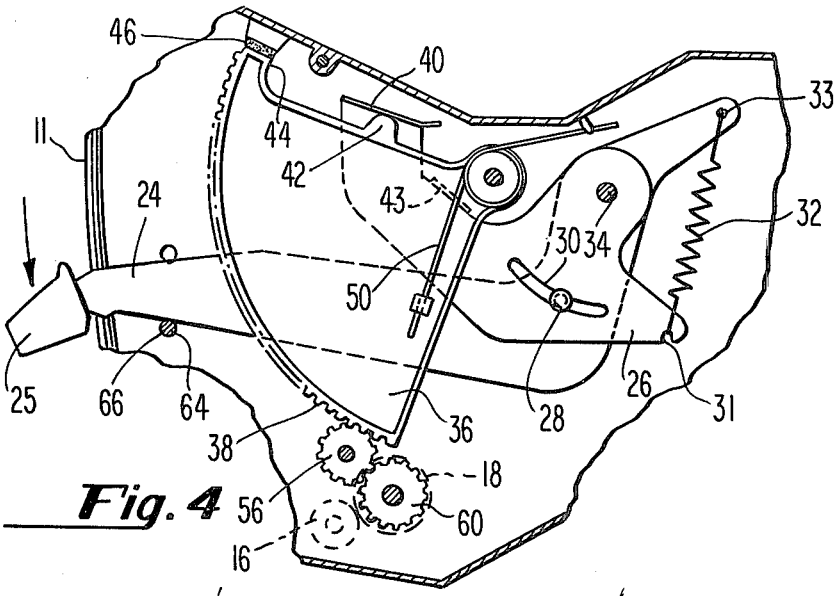
FIG. 4 is a partial side elevation view of the drive mechanism illustrating means for preventing excessive force applied to the lever from being transmitted to the gearing means.

For the sake of convenience, an element depicted in more than one figure will retain the same element number in each figure. Referring now to FIG. 1 of the drawings, a dispensing cabinet 10 is shown with a portion of its front and side walls removed to reveal the dispensing mechanism of this invention. Shown within the cabinet is a roll 12 of a sheet material, such as a sanitary paper towel, that is wound on a core 13. A pair of spaced-apart support members 22 are mounted within the cabinet 10 and are adapted to extend into the ends of the core 13 so as to rotatably support the roll 12. The leading end 14 of the roll of sheet material is fed into and through a nip formed by a pressure roller 16 and a drive roller 18. Although the sheet has been described as passing through a rolling nip, it is clear that pressure roller 16 could be replaced, for example, by a stationary, smooth surface. It is preferred that the surface of one of the rollers 16, 18 have a greater coefficient of friction than the other surface. In one embodiment, pressure roller 16 is made out of wood which has a relatively smooth surface and drive roller 18 is made out of rubber which has a frictional surface. In a preferred embodiment, as best shown in FIG. 3, the drive roller 18 is mounted so that it has a fixed axis of rotation while the pressure roller 16 is mounted so that its axis of rotation can move toward and away from the axis of rotation of the drive roller 18. To accomplish this, the ends 17 of pressure roller 16 are mounted in brackets 19, and coil springs 21, also housed in brackets 19, exert a force on the ends 17 of the pressure roller 16 causing pressure to be applied to the sheet material 14 in the nip formed by the pressure roller 16 and the drive roller 18.

Referring now to FIG. 1, one mechanism for applying drive to the drive roller 18 will now be described. A lever 24 having a knob 25 that projects through the front wall 11 of the dispenser 10 is mounted for rotation about a shaft 34 within the dispensing cabinet 10. An actuator 26 is also mounted for rotation about shaft 34. A portion 43 of the actuator 26, bent over in the direction of the lever 24, acts as a stop that limits the relative rotation of the lever 24 with respect to the actuator 26. A spring 32, having one end hooked into a notch 31 in actuator 26 and having the other end hooked into a hole 33 in the lever 24, biases the upper edge of the lever 24 against the stop portion 43 of the actuator 26. It may be desirable to assemble the lever 24, the actuator 26 and the spring 32 into a subassembly which can then be assembled as a unit into the dispenser 10. For that purpose, the actuator 26 can be fabricated with an arcuate slot 30 having a curvature that is concentric about a mounting hole for shaft 34. A shoulder rivet 28 extending through the arcuate slot 30 and riveted to the lever 24 maintains a fixed spaced relationship between the lever 24 and the actuator 26, but when assembled into the dispenser 10, allows lever 24 to rotate with respect to actuator 26 through an angle as determined by the length of arcuate slot 30.

A gear segment 36 having a plurality of gear teeth 38 about its periphery is mounted for rotation about a shaft 49. The gear segment 36 includes a projection 44 which, at the return position, rests against a cushioned stop 46 that limits the rotation of the gear segment 36 in one direction. A return spring 50 which is supported by an extended hub 48 of the gear segment 36 has one end held by a retainer tab 52 located on a wall member within the dispensing cabinet 10 and has the other end located in a similar retainer tab 54 located on the gear segment 36. Return spring 50 biases gear segment 36 at the return position against the cushioned stop 46.

A portion of the actuator 26 is bent over in the direction of the gear segment 36 to provide a flange surface 40. Gear segment 36 includes a raised, radiused section 42 which contacts the flange surface 40 of actuator 26. When the knob 25 of the lever 24 is depressed, both the actuator 26 and the lever 24 will rotate about shaft 34, and due to the pressure applied by the flange surface 40 on the raised portion 42, gear segment 36 is caused to rotate about shaft 49. When the knob 25 is released, return spring 50 will cause the gear segment 36, and the actuator 26 and lever 24 subassembly to go back to the return position.

The gear teeth 38 of gear segment 36 engage a floating idler gear 56. The shaft 57 of idler gear 56 is mounted in slots 58 which are aligned generally parallel to the gear teeth 38 on the periphery of gear segment 36. When shaft 57 of idler gear 56 is located at the end of slots 58 near the drive roller 18, the idler gear 56 is in driving engagement with a gear 60 mounted on a shaft 61 of the drive roller 18. When shaft 57 of idler gear 56 is located at the end of slots 58 remote from the drive roller 18, as shown in FIG. 3, the idler gear 56 is disengaged from the gear 60 mounted on shaft 61 of the drive roller 18.

As best illustrated in FIG. 1, it may be desirable to provide a number of different stop positions for lever 24 in order to select the length of the sheet material 14 that is dispensed through the opening 20 of dispensing cabinet 10. Thus, when the lever 24 is depressed so that the knob 25 coincides with the dashed position 25C, the bottom edge 63C of the lever 24 hits a cushioned stop 62 mounted within the dispensing cabinet 10. Two other stop positions, illustrated by dashed outlines 25A and 25B of the handle 25 of lever 24, can be provided by inserting a retaining pin 64 into either holes 66 or holes 68 in interior sidewalls within the dispensing cabinet 10.

Figure 2:
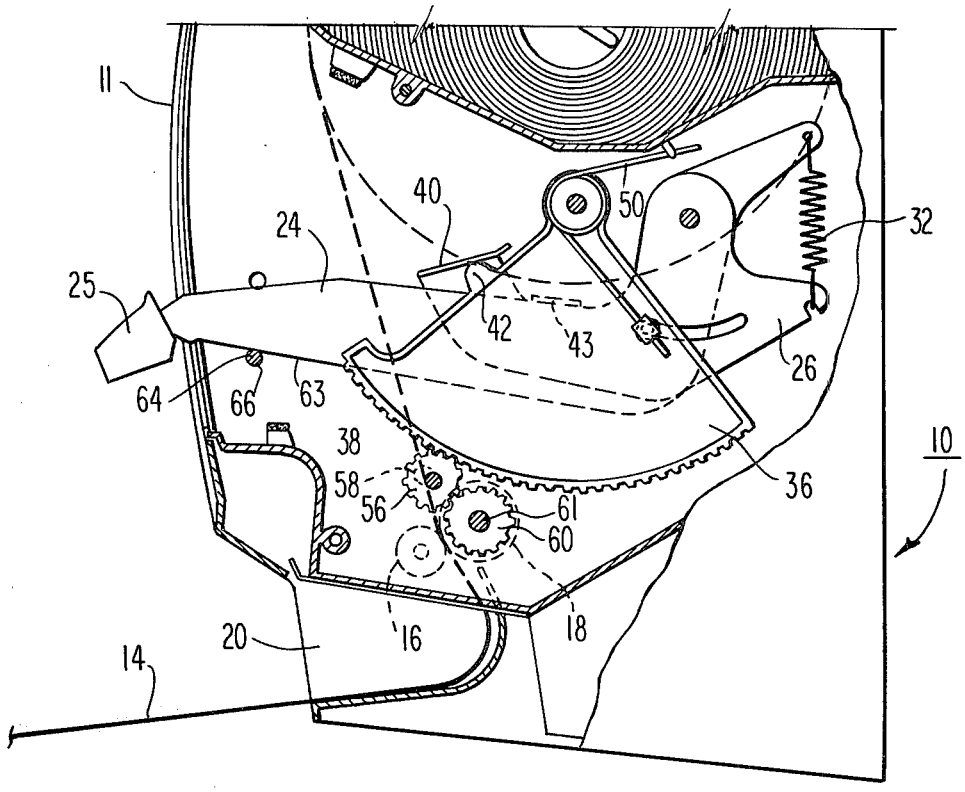
FIG. 2 is a partial side elevation view illustrating the dispensing action when the lever is depressed.

In operation, the operator causes the gear segment 36 to reciprocate between cushioned stop 46 and a stop, such as stop pin 64. Under normal dispensing conditions, the lever 24 and the actuator 26 are biased at the stop 43 by spring 32 and rotate as a single unit. As the lever 24 is depressed and caused to rotate about shaft 34, the flange 40 of actuator 26 which bears against the raised, radiused portion 42 of gear segment 36 causes gear segment 36 to rotate in a counter clockwise direction about shaft 49. Since the gear teeth 38 of gear segment 36 engage the teeth of floating idler gear 56, as the gear segment 36 begins to rotate it causes floating idler gear 36 to rotate and to move along slot 58 towards and into engagement with gear 60 mounted on the shaft 61 of drive roller 18. Continued counterclockwise rotation of gear segment 36 results in rotation of drive roller 18 in a counter-clockwise direction. Due to the combined action of pressure roller 16 pressing the end of the sheet material 14 in the nip against the surface of drive roller 18 and the coefficient of friction between the sheet material 14 and the surface of drive roller 18, as drive roller 18 rotates it drives the sheet material 14 through the nip. As best shown in FIG. 2, when lever 24 has reached the end of its downward travel, which occurs when the lower edge 63 of lever 24 contacts the stop pin 64 inserted in stop holes 66, the desired length of the sheet material 14 has been dispensed through the opening 20 in the front wall of the dispensing cabinet 10. The sheet material 14 can be removed by pulling it against a cutter edge (not shown) mounted in the bottom portion of the dispensing cabinet 10.

When the operator releases the knob 25 of lever 24, return spring 50 will cause the gear segment 36 and the lever 24 and actuator 26 subassembly to return to the starting position, as illustrated in FIG. 1. When the gear segment 36 rotates in the clockwise direction, it is necessary to remove the driving force from gear 60 mounted to the shaft 61 of drive roller 18 in order to prevent the drive roller 18 from pulling the free end of the sheet material 14 through the nip and back into the dispensing cabinet 10. As best shown in FIG. 3, as gear segment 36 begins to rotate in a clockwise direction, it causes the floating idler gear 56 to begin rotating in the counter-clockwise direction and also causes the shaft 57 of floating idler gear 56 to move in slots 58 in the direction away from drive roller 18 which disengages the floating idler gear 56 from gear 60 thereby removing drive from the drive roller 18 while the gear segment 36 is rotating towards the return position.

On occasion, one of the geared members may become jammed and be unable to rotate, which could occur, for example, if the sheet material 14 bunched up within the nip formed by the pressure roller 16 and the drive roller 18 thereby preventing rotation of the drive roller 18. Under these conditions, an operator may try to force the dispensing of the sheet material by applying an excessive force on the knob 25 of lever 24. The actuator 26, lever 24 and spring 32 subassembly prevents excessive shock forces from being transmitted to the gear teeth 38 on gear segment 36 or to the floating idler gear 56 or to the gear 60 mounted on the shaft 61 of drive roller 18 which may strip the gear teeth of those members or otherwise damage the drive mechanism. Spring 32 normally biases the upper edge of lever 24 against the stop 43 of the actuator 26. When the drive mechanism is jammed and the operator moves the knob 25 of lever 24 down in the dispensing direction, the jammed condition prevents gear segment 36 from rotating in the counter-clockwise direction and a force is developed at the contact between the raised portion 42 of the gear segment 36 and the flange surface 40 of actuator 26 that tends to rotate actuator link 26 in the clockwise direction. If the downward pressure applied by the operator on knob 25 of lever 24 exceeds the force of spring 32 that biases lever 24 against the stop 43 of actuator 26, the spring 32 will expand to allow relative rotation of the lever 24 with respect to actuator 26. Spring 32 in so expanding absorbs some of the energy of the excessive shock load and limits the shock load that is applied to the gear segment 36 which may tend to strip the gears or otherwise damage the drive mechanism.

Figure 5:
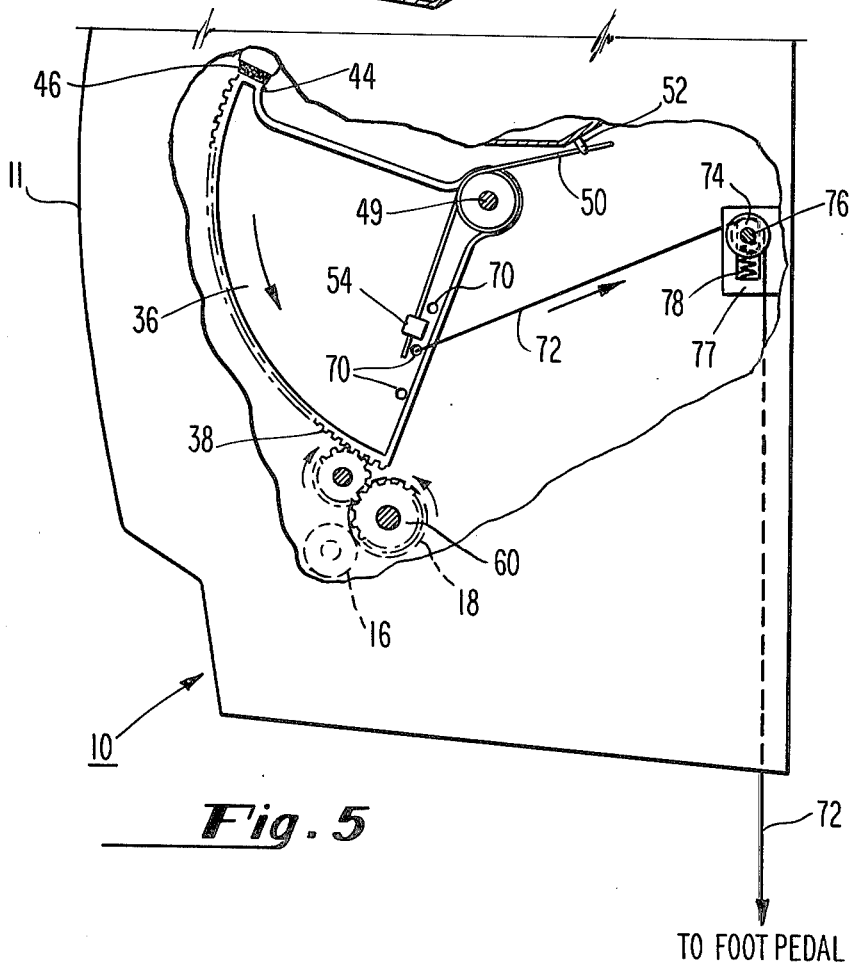
FIG. 5 is a partial side elevation view of a pedal operated version of the dispensing apparatus.

FIG. 5 illustrates a pedal-operated version of the dispenser 10. Mounted at the rear of the cabinet are brackets 77 which support the shaft 76 of a pulley 74. A cable 72 having one end secured in hole 70 in the gear segment 36 passes over the pulley 74 and down to a foot pedal (not shown). When the operator steps on the foot pedal, cable 72 causes gear segment 36 to rotate which causes the sheet material 14 to be dispensed through the nip formed by pressure roller 16 and drive roller 18 as previously described. When the operator steps off the foot pedal, the return spring 50 causes gear segment 36 to rotate back to the starting position against cushioned stop 46. Some adjustment in the amount of paper dispensed and pedal force required to operate the dispenser is provided by having several holes 70 spaced at different radial distances from the center of rotation 49 of gear segment 36.

It may be desirable in a pedal operated version of the dispenser 10 to support shaft 76 of pulley 74 on springs 78, which would act as overload shock absorbers, mounted within the brackets 77. If the dispenser 10 were jammed and gear segment 36 were unable to rotate, an excessive force applied to the foot pedal would cause compression of the springs 78 thereby preventing the full shock load from being transmitted to the gearing mechanism.

There are several advantages to having the gear segment 36 rotate about one point such as shaft 49 and having the lever 24 and actuator 26 assembly rotate about a different point such as shaft 34. When the distance from the center of rotation 34 of the lever 24 and actuator 26 assembly to the contact point between flange 40 and raised portion 42 of gear segment 36 is greater than the distance between the center of rotation 49 of the gear segment 36 to the contact point between flange 40 and raised portion 42, rotation of the lever 24 will cause gear segment 36 to rotate through an angle that is greater than the angle of rotation of the lever 24. In one constructed embodiment, when the lever 24 rotates through an angle of about 40°, the gear segment 36 rotates through an angle of about 70°. Another advantage of having the gear segment 36 rotate about one point and having the lever 24 and actuator 26 assembly rotate about a second point is that as the lever 24 rotates, the contact point of the raised portion 42 of gear segment 36 against the flange 40 of actuator 26 moves back toward the center of rotation of the lever 34. This increases the mechanical advantage of the lever 24 and actuator 26 subassembly, and, in part compensates for the increased force of the dispensing mechanism due to the action of the return spring 50.

While the present invention has been described with reference to a specific embodiment thereof, it will be obvious to those skilled in the art that various changes and modifications may be made without departing from the invention in its broader aspects. For example, although the embodiment depicted in FIG. 1 employs a subassembly comprising lever 24, actuator 26 and spring 32 to effect rotation of the gear segment 36, it will be apparent to those skilled in the art, that the actuator 26 and the spring 32 are not essential for causing the gear segment 36 to rotate. If the shock absorbing feature were not desired, the actuator 26 and the spring 32 would not be required. In that case, a portion of the lever 24 could be bent over to provide a flange surface that is equivalent to the flange 40 of actuator 26 and which would contact the raised portion 42 of gear segment 36.

Furthermore, although the gear segment 36 includes a raised portion 42 that is radiused in its upper surface for contacting a flange 40 of actuator 26, equally satisfactory operation would be obtained if the actuator 26 included a radiused portion which contacted a flat surface of gear segment 36. Other arrangments could also be provided to cause rotation of the gear segment 36, such as, replacing the raised, radiused portion 42 by a roller to reduce the friction between the actuator 26 and the gear segment 36.

Also, although the idler gear 56 has been described as mounted in a slot 58, it will be clear to those skilled in the art that the important feature is that the idler gear 56 can move into and out of engagement with gear 60 connected to shaft 61 of drive roller 18. This motion could, for example, also be provided by mounting the idler gear 56 in an arm member mounted for limited rotation about shaft 49.

From the above discussion it can be seen that there is an advantage, in a lever operated sheet material dispenser that includes a gear segment for dispensing the sheet material, to having the lever rotate about one point and to have the gear segment, which is actuated by the lever, rotate about a second point. By proper selection of the point of contact between the lever and the gear segment, the gear segment can be caused to rotate through a greater angle than the angle of rotation of the lever. Another advantage of the dispenser of this invention is that the mechanical advantage provided by the lever increases as the lever is depressed thereby compensating in part for the increased resistance to dispensing caused by any return spring mechanism.

This invention also provides a very simple means in the form of a movable floating idler gear that is engaged by the gear segment, for rotating the drive roller only during one direction of travel of the lever.

What is claimed as new and desired to be secured by Letters Patent of the United States is:

1. An apparatus for feeding sheet material through a nip with a rotatably mounted drive roller comprising:
(a) a gear segment mounted for rotation about a first point;
(b) a lever pivotally mounted about a second point, said lever having a surface in moving contact with a portion of the gear segment so that rotation of the lever through a given angle causes the gear segment to rotate through an angle greater than said given angle; and
(c) gear means driven by the gear segment and operably connected to the drive roller so that rotation of the gear segment results in rotation of the drive roller whereby the sheet material is dispensed through the nip.

2. An apparatus for feeding sheet material through a nip with a rotatably mounted drive roller comprising:
(a) a gear segment mounted for rotation about a first point;
(b) a lever pivotally mounted about a second point, said lever having a surface in moving contact with a portion of the gear segment, the distance from the first point to said point of contact being less than the distance from the second point to said point of contact whereby rotation of the lever through a given angle causes the gear segment to rotate through an angle greater than said given angle; and
(c) gear means driven by the gear segment and operably connected to the drive roller so that rotation of the gear segment results in rotation of the drive roller whereby the sheet material is dispensed through the nip.

3. An apparatus for feeding sheet material through a nip formed with a rotatably mounted drive roller comprising:
(a) first gear means;
(b) means, operably connected to the first gear means, for reciprocating the first gear means;
(c) a movable gear, engaged by the first gear means; and
(d) second gear means operatively connected to the drive roller, wherein the movable gear is moved into driving engagement with the second gear means to feed the sheet material through the nip when the first gear means moves in one direction, and wherein the movable gear is moved and is disengaged from the second gear means when the first gear means moves in the opposite direction.

4. An apparatus as recited in claim 3 wherein the movable gear is mounted in a slot generally aligned parallel to the teeth of the first gear means.

5. An apparatus as recited in claim 3 wherein the first gear means is a rotatable gear segment.

6. An apparatus as recited in claim 5 wherein the reciprocating means comprises:
(a) a pedal-operated cable connected to the gear segment for causing the gear segment to rotate in one direction; and
(b) means for causing the gear segment to rotate in the other direction.

7. In a dispensing cabinet, an apparatus for feeding a sheet material through a nip formed by a rotatably mounted drive roller and a rotatably mounted pressure roller comprising:
(a) a gear segment mounted for rotation about a first point;
(b) a lever pivotally mounted about a second point;
(c) an actuator pivotally mounted about the second point, said actuator having a surface in moving contact with a portion of the gear segment, and said lever and actuator including a stop that limits the rotation of the lever with respect to the actuator;
(d) spring means for biasing the lever and actuator at the stop, so that rotation of the lever and the actuator through a given angle normally causes the gear segment to rotate through an angle greater than said given angle but when excessive force is applied to the lever and the actuator is unable to rotate, the spring means expands to allow the lever to rotate with respect to the actuator; and (e) gear means driven by the gear segment and operably connected to the drive roller so that rotation of the gear segment results in rotation of the drive roller whereby the sheet material is fed through the nip and dispensed from the cabinet.

8. An apparatus as recited in claim 7 wherein the gear means comprises:

(a) a gear engaged by the gear segment, said gear being mounted in a slot generally aligned parallel to the teeth of the gear segment; and (b) gear means operatively connected to the drive roller, wherein the slot mounted gear is moved along the slot into driving engagement with the second gear means to feed the sheet material through the nip and out of the cabinet when the gear segment rotates in one direction and wherein the slot mounted gear is moved along the slot and is disengaged from the second gear means when the gear segment rotates in the opposite direction.

* * * * *

Disclaimer 4,192,442.—*Lehyman J. Bastian,* Media, Pa., and *Richard D. Kley,* New Castle, Del. ROLL SHEET DISPENSER. Patent dated Mar. 11, 1980. Disclaimer filed Jan. 3, 1984, by the assignee, *Scott Paper Co.*

Hereby enters this disclaimer to claims 3–6 of said patent.

[*Official Gazette February 28, 1984.*]